US012799741B2

(12) United States Patent
Johnson

(10) Patent No.: US 12,799,741 B2
(45) Date of Patent: Nov. 17, 2026

(54) WEATHERPROOF BRIDGE GAP FASCIA COVER AND SYSTEM

(71) Applicant: Kustom Design Capping, LLC., Akron, OH (US)

(72) Inventor: Sabrina Lee Johnson, Akron, OH (US)

(73) Assignee: Kustom Design Capping, LLC, Akron, OH (US)

( * ) Notice: Subject to any disclaimer, the term of this patent is extended or adjusted under 35 U.S.C. 154(b) by 196 days.

(21) Appl. No.: 18/610,385

(22) Filed: Mar. 20, 2024

(65) Prior Publication Data

US 2024/0376718 A1 Nov. 14, 2024

Related U.S. Application Data

(60) Provisional application No. 63/501,736, filed on May 12, 2023.

(51) Int. Cl.
*E04D 13/158* (2006.01)
*E04D 13/04* (2006.01)

(52) U.S. Cl.
CPC ..... *E04D 13/158* (2013.01); *E04D 13/0459* (2013.01); *E04D 2013/0468* (2013.01)

(58) Field of Classification Search
CPC ..... E04D 13/158; E04D 13/0459; E04D 2013/0468; E04D 13/15
See application file for complete search history.

(56) References Cited

U.S. PATENT DOCUMENTS

| | | | | |
|---|---|---|---|---|
| 5,321,921 | A * | 6/1994 | Holt | E04C 3/02 52/716.2 |
| 5,507,123 | A * | 4/1996 | Holt | E06B 7/26 52/716.2 |
| 5,884,435 | A * | 3/1999 | David | E04F 19/061 52/302.6 |
| 8,316,587 | B2 * | 11/2012 | Shugart | E04D 13/158 52/95 |
| 9,556,973 | B2 * | 1/2017 | Rumsey | H05B 3/06 |
| 10,077,558 | B2 * | 9/2018 | Heo | E04D 1/3405 |
| 10,968,635 | B1 * | 4/2021 | Duran | E04D 3/363 |
| 2003/0177708 | A1 * | 9/2003 | Gatherum | E04D 13/1415 52/62 |
| 2006/0080900 | A1 * | 4/2006 | Graham | E04D 13/158 52/24 |
| 2007/0266657 | A1 * | 11/2007 | Gembala | E04D 13/15 52/288.1 |
| 2024/0376718 | A1 * | 11/2024 | Johnson | E04D 13/155 |

* cited by examiner

*Primary Examiner* — Andrew J Triggs
(74) *Attorney, Agent, or Firm* — Renner, Kenner, Greive, Bobak, Taylor & Weber Co. LPA

(57) ABSTRACT

A weatherproof bridge gap fascia cover including a fascia board cover portion, and a bridge gap interface portion, wherein the bridge gap interface portion includes a cap portion extending outwardly from the fascia board cover portion and a face portion extending downwardly from the cap portion. A weatherproof bridge gap fascia cover system for creating a weatherproof seal at a fascia and cladding interface of a roof and sidewall using the weatherproof bridge gap fascia cover and methods of forming a weatherproof bridge gap fascia cover system for creating a weatherproof seal at a fascia and cladding interface.

8 Claims, 7 Drawing Sheets

WEATHERPROOF BRIDGE GAP FASCIA COVER AND SYSTEM

CROSS-REFERENCE TO RELATED APPLICATIONS

This application claimed by benefit of U.S. Provisional Patent Application No. 63/501,736, filed May 12, 2023, the disclosure of which is incorporated by reference herein.

FIELD OF THE INVENTION

The inventions disclosed herein relate to building envelopes and more specifically to a fascia with a seal for weatherproofing, which protects a top outer peripheral edge of a building from experiencing water damage from water penetrating between a fascia and a side of a building.

BACKGROUND OF THE INVENTION

For years, exterior residential remodeling contractors have observed water damage to both exteriors and interiors of houses. For some houses, the water damage may stem from years of prior water penetration where the leak takes large amounts of time before finally showing itself, much like a sponge that has become excessively soaked and is now leaking. In some occurrences, these leaks will only be observed during a wind driven rainy day or after severe ice build-up. Some residential property owners become concerned but tend to disregard the presence of the leak, particularly where there is no observed leak during the next rainstorm or cold spell. Oftentimes, a water stain is left behind from said water penetration and the homeowner attempts to paint over it, wherein it is likely that the stain will reoccur with the leak again.

Accordingly, many residential property owners have expended significant costs for remediation using exterior residential remodeling contractors who attempt to locate the leak and ascertain the reason for the leak, or why there is a ceiling, stain or mold issue. Some of these contractors never find and locate the root cause for said leaks and water penetration. Furthermore, the contractors attempt unsuitable remediation methods that are provided at significant costs and fail to prevent further leaking and water penetration. Thus, homeowners are left to seek the services of other contractors to further attempt to seal a pre-existing leak and fault the previous contractor for failing to complete the job.

Portions of homes with no true overhang projection/rake overhang (e.g., a house that does not have a soffit) are particularly prone to leaks. This is primarily the result of having two separate systems that are adjacent to each other, but do not interconnect. Conventional sidewall and roof interface systems, designated as "Prior Fascia Art," are utilized for where a house sidewall meets a fascia below the roof. Two exemplary Prior Fascia Art systems are depicted in FIGS. 1-4. In both systems, a house sidewall is covered with aluminum or vinyl siding that includes a J-Channel facing outward. Said J-Channels may extend 0.5" or greater perpendicular to the sidewall. Above the sidewall is a fascia, which is typically painted wood, as shown in FIGS. 1 and 2, or covered by aluminum fascia, as shown in FIGS. 3 and 4. Such aluminum fascia is typically provided in 4", 6" or 8" heights and covers the fascia located between the roof and the sidewall. Oftentimes, a roofing system will include an aluminum drip edge that overhangs and bends downwardly towards the fascia and sidewall from the roof. In such case, the aluminum fascia is installed between the wood fascia and the downward portion of the roofing drip edge at the top of the fascia. In such systems, standards for installing aluminum fascia in the housing construction industry is either to end the aluminum fascia at the outside bottom of the wood fascia so as not to cover the aluminum or vinyl siding, or to fold the aluminum fascia inward between the wood fascia and the house sidewall, creating a backwards L-shaped capping structure to the aluminum fascia. Notably, the aluminum fascia and the siding's J-channel structure are not connected. In standard configurations, the aluminum fascia mere butts against the siding, including the J-channel structure. Under practices and proper installation methods approved by manufacturers of siding and the Vinyl Siding Institute (VSI), the aluminum fascia and siding are aligned during installation. Due to the forces of time and exposure to the elements, despite even the best installation practices for each structure, water will inevitably find a way to penetrate through this abutted area, as shown in FIG. 4.

For most housing construction applications, the fascia and the siding are typically manufactured out of two different compositions (e.g., aluminum to vinyl) or two different gauges of the same composition (e.g., 26-gauge aluminum to 44-gauge aluminum). New siding materials such as engineered composites and fiberboard siding are being introduced to the market. Each of these types of materials, including different gauges of the same type of material, expand and contract at different ratios in heat and cold. Therefore, there is no perfect expansion/contraction of these two products together at the fascia and sidewall siding J-channel interface or abutted area. Continuous cycles of differential expansion/contraction eventually results in the formation of gaps and other areas of misalignment providing greater opportunity for water penetration over time.

Manufacturers and installers of siding have attempted to address this problem by introducing products that may be periodically adjusted to maintain the interface between the fascia material and the siding J-channel. However, this was only because the remodeling contractor chose to not fold the fascia into the gap between the wood fascia and the housing sidewall. Effective coverage only occurs if the actual fascia and siding were flush with each other. Otherwise, misalignment or improper adjustments cause the fascia backwards L capping portion to bulge outward, away from the wall.

Thus, rain, snow and ice are able to penetrate the exterior of a structure at the interface/junction/merge of the bottom of the wood fascia and top of the sidewall or siding J-channel structure. Accordingly, conventional methods of installing these systems to form this interface allows the water to penetrate the exterior of the structure and run down between the sidewall and the siding or on the interior said of the sidewall, causing deterioration of the wall substrate, and insulation. Water penetration can also cause mold and mildew to develop in these areas. Due to the nature of this type of water penetration, severe damage may develop without any indication to the occupants. Furthermore, water may seep over the top of the housing sidewall and into the interior part of the sidewall and into the house, causing water stains and other water-related damage and issues.

Hence, there exists a need for improved assemblies and methods for preventing water from penetrating between the wood fascia and the siding J-channel structure, or between other structures on the exterior of the house where two structures abut and are not protected by other structures.

SUMMARY OF THE INVENTION

At least one embodiment of the present invention provides a weatherproof bridge gap fascia cover comprising a fascia board cover portion, and a bridge gap interface portion, wherein the bridge gap interface portion includes a cap portion extending outwardly from the fascia board cover portion and a face portion extending downwardly from the cap portion.

Another embodiment of the present invention provides a weatherproof bridge gap fascia cover as in any embodiment above, wherein the fascia board cover portion and bridge gap interface portion is a one-piece construction.

Still another embodiment of the present invention provides a weatherproof bridge gap fascia cover as in any embodiment above, wherein the fascia board cover portion forms a first plane.

Yet another embodiment of the present invention provides a weatherproof bridge gap fascia cover as in any embodiment above, wherein the cap portion forms a second plane.

A further embodiment of the present invention provides a weatherproof bridge gap fascia cover as in any embodiment above, wherein the face portion forms a third plane.

Still a further embodiment of the present invention provides a weatherproof bridge gap fascia cover as in any embodiment above, wherein the fascia board cover portion includes a rigidity bend.

Yet a further embodiment of the present invention provides a weatherproof bridge gap fascia cover as in any embodiment above, wherein the fascia board cover portion has a height of about 4 inches or greater.

Still another embodiment of the present invention provides a weatherproof bridge gap fascia cover as in any embodiment above, wherein the cap portion extends 0.5 inches or greater in length from the fascia board cover portion.

Yet another embodiment of the present invention provides a weatherproof bridge gap fascia cover as in any embodiment above, wherein the weatherproof bridge gap fascia cover is 10 feet long.

And still another embodiment of the present invention provides a weatherproof bridge gap fascia cover as in any embodiment above, comprising a material selected from the group consisting of coated aluminum coil, aluminum extrusion, and vinyl extrusion.

At least one embodiment of the present invention provides a weatherproof bridge gap fascia cover system for creating a weatherproof seal at a fascia and cladding interface, having a roof and a sidewall, the system comprising the roof having a drip edge, a fascia board adjacent to the drip edge, a cladding attached to the sidewall, wherein the cladding includes a J-channel portion, a weatherproof bridge gap fascia cover, and wherein the fascia board and the cladding form an interface, and wherein the weatherproof bridge gap fascia cover is fastened to the fascia board to thereby form the weatherproof seal covering both the fascia board and the J-channel portion of the cladding.

Another embodiment of the present invention provides a weatherproof bridge gap fascia cover system for creating a weatherproof seal at a fascia and cladding interface, having a roof and a sidewall as in any embodiment above, wherein the weatherproof bridge gap fascia cover comprises a fascia board cover portion, and a bridge gap interface portion, wherein the bridge gap interface portion includes a cap portion extending from the fascia board cover portion and away from the sidewall, and a face portion extending from the cap portion and over the cladding.

A further embodiment of the present invention provides a weatherproof bridge gap fascia cover system for creating a weatherproof seal at a fascia and cladding interface, having a roof and a sidewall as in any embodiment above, further comprising a preexisting fascia cover fastened to the fascia board, and wherein the weatherproof bridge gap fascia cover is fastened to the preexisting fascia cover.

Still another embodiment of the present invention provides a weatherproof bridge gap fascia cover system for creating a weatherproof seal at a fascia and cladding interface, having a roof and a sidewall as in any embodiment above, wherein a top portion of the fascia board cover portion is pinned between the fascia board and a face of the drip edge.

Yet another embodiment of the present invention provides a weatherproof bridge gap fascia cover system for creating a weatherproof seal at a fascia and cladding interface, having a roof and a sidewall as in any embodiment above, wherein the weatherproof bridge gap fascia cover is fastened to the fascia board with siding trim nails.

At least another embodiment of the present invention provides a method for forming a weatherproof bridge gap fascia cover system, the method comprising providing a fascia and cladding interface, wherein the fascia and cladding interface comprises a roofing system including a drip edge, a fascia board adjacent to the edge, and a cladding attached to a sidewall, providing a weatherproof bridge gap fascia cover, aligning the weatherproof bridge gap fascia cover with the drip edge and the cladding, and fastening the weatherproof bridge gap fascia cover to the fascia board to thereby form the weatherproof seal covering the fascia and cladding interface.

A further embodiment of the present invention provides a method for forming a weatherproof bridge gap fascia cover system as in any embodiment above, wherein the weatherproof bridge gap fascia cover comprises a fascia board cover portion, and a bridge gap interface portion, wherein the bridge gap interface portion includes a cap portion extending from the fascia board cover portion and away from the sidewall, and a face portion extending from the cap portion and over the cladding.

Yet a further embodiment of the present invention provides a method for forming a weatherproof bridge gap fascia cover system as in any embodiment above, wherein the fascia board further comprises a preexisting fascia cover, wherein the step of fastening the weatherproof bridge gap fascia cover to the fascia board further includes fastening the weatherproof bridge gap fascia cover to the preexisting fascia cover.

And a further embodiment of the present invention provides a method for forming a weatherproof bridge gap fascia cover system as in any embodiment above, wherein the step of fastening the weatherproof bridge gap fascia cover to the fascia board includes using siding trim nails.

DETAILED DESCRIPTION OF ILLUSTRATIVE EMBODIMENTS

Figure 1:
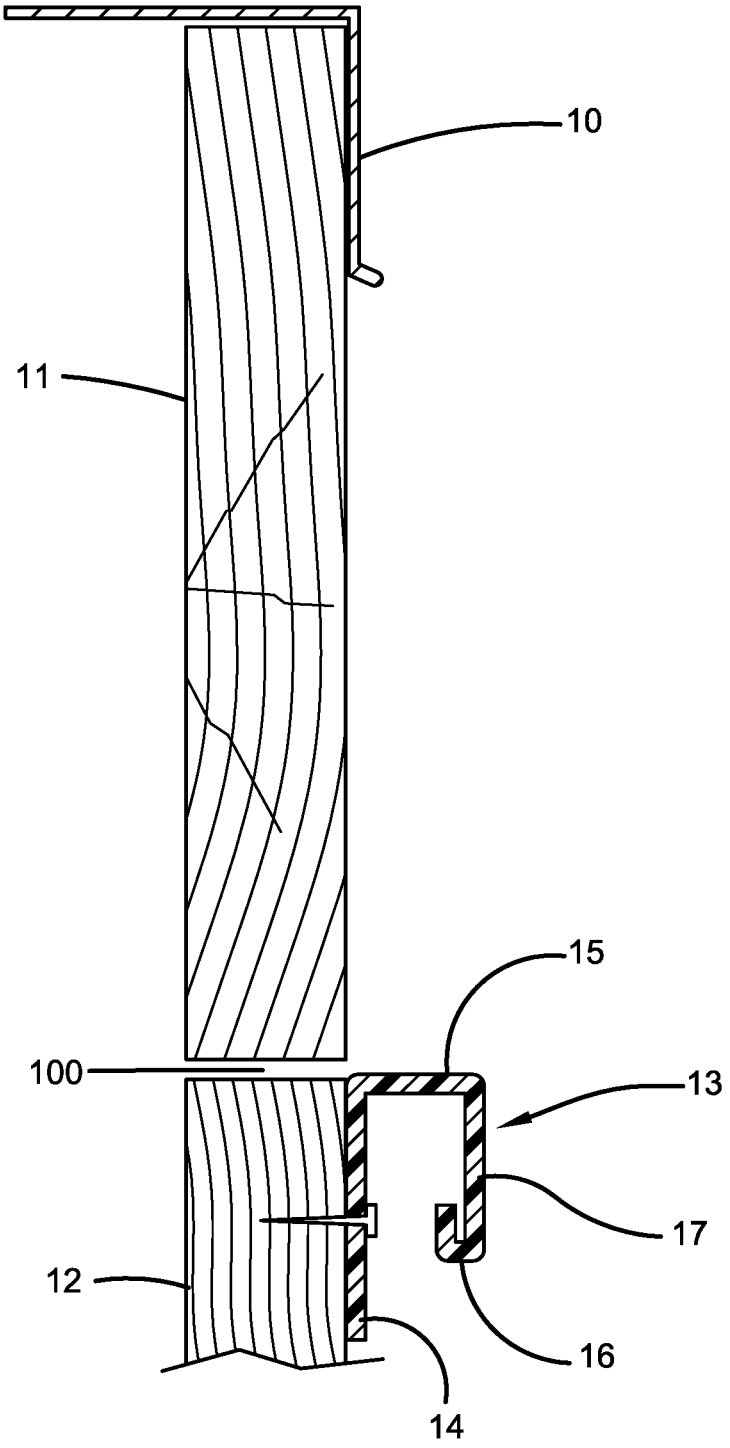
FIG. 1 is a cross-sectional view of a fascia board system without a cover.
Figure 2:
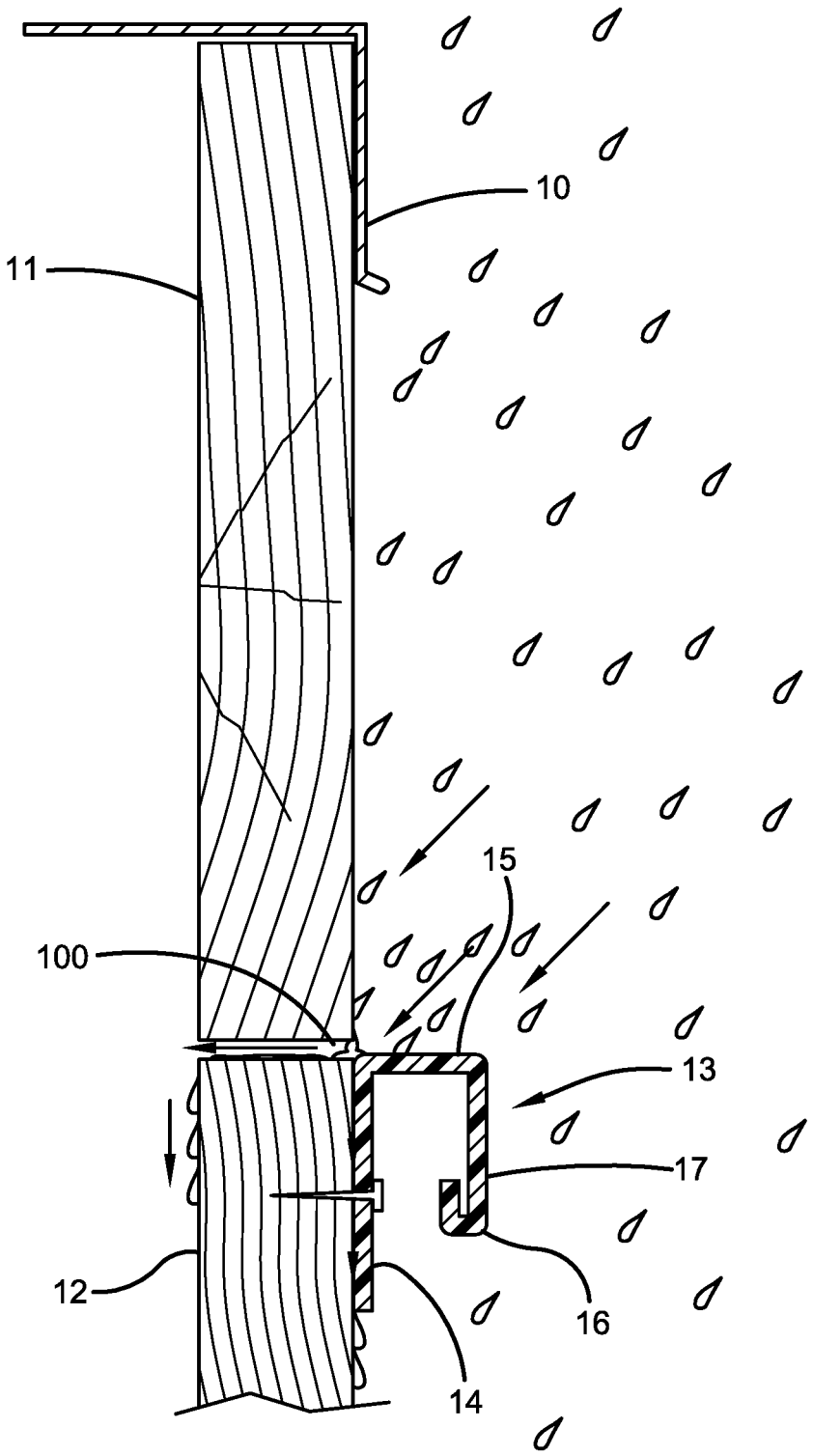
FIG. 2 is a cross-sectional view of a fascia board system without a cover experiencing water penetration.
Figure 3:
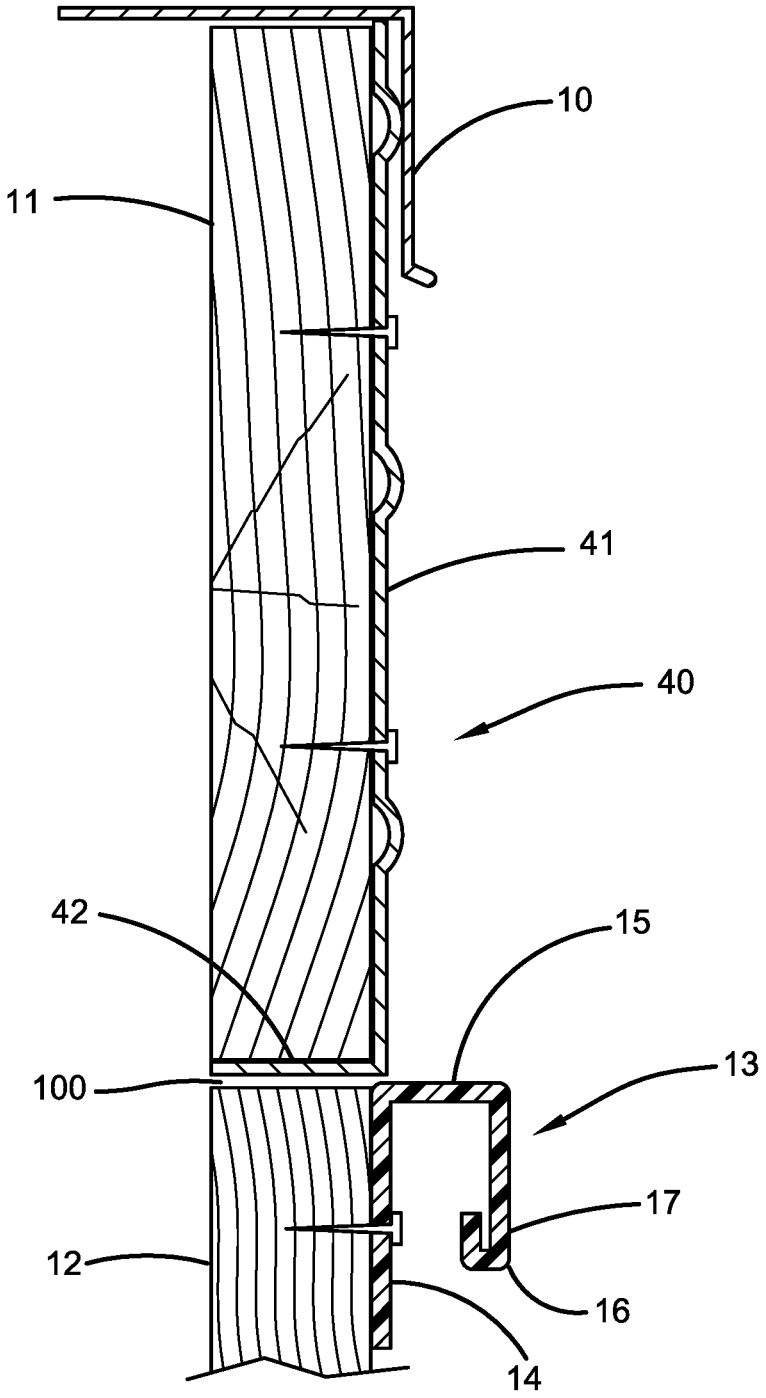
FIG. 3 Prior Art
FIG. 3 is a cross-sectional view of a prior art fascia cover system.
Figure 4:
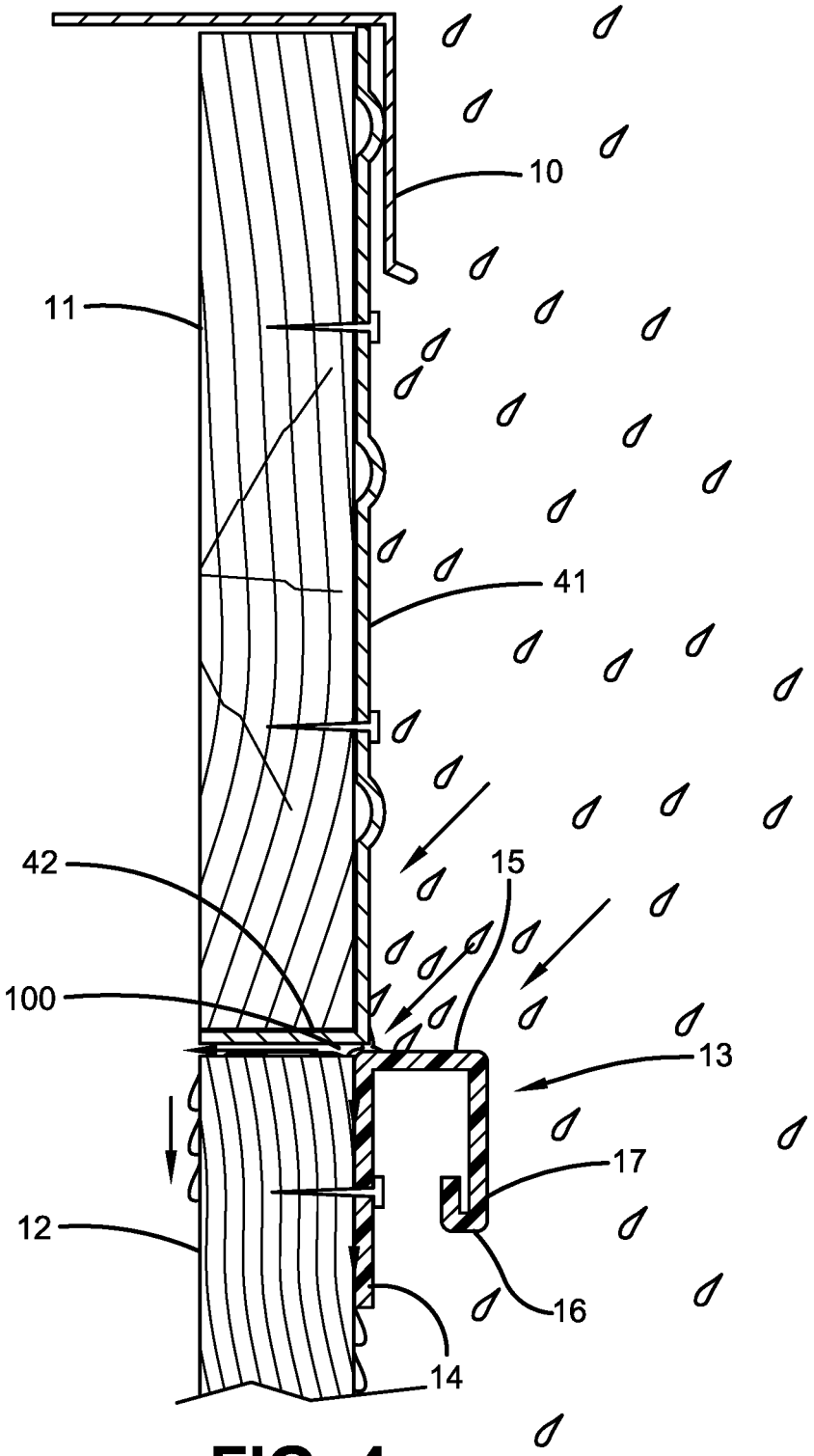
FIG. 4 Prior Art
FIG. 4 is a cross-sectional view of a prior art fascia cover system experiencing water penetration.

As illustrated in FIGS. 1-4, a fascia and cladding interface is formed where a fascia board and sidewall, including cladding, meet. Embodiments of the present invention are compatible with a wide variety of fascia and cladding systems. In some embodiments, the building system includes a roofing system, a fascia board, and a sidewall including cladding. As shown in FIGS. 1-4, drip edge 10, fascia board 11, sidewall 12, and cladding 13, are part of a roofing and wall interface of a building. Cladding 13, includes siding 14, outward cladding extension 15, exterior cladding portion of J-channel 16, and bent end portion of J-channel 17. Fascia and cladding interface 100 is formed at the abutment of fascia board 11 and sidewall 12 including cladding 13. In FIGS. 3 and 4, a prior art fascia cover 40 is shown. Fascia cover 40 includes fascia board cover portion 41 and L-bend portion 42, where L-bend portion 42 is configured to be inserted at fascia and cladding interface 100. As described above in the background of the invention, fascia and cladding interface 100 is vulnerable to water penetration regardless of whether fascia cover 40 is present.

Weatherproof Bridge Gap Fascia Covers and Systems

Embodiments of weatherproof bridge gap fascia covers according to the present invention are described. In some embodiments, bridge gap fascia covers according to the present invention include a fascia board cover portion and a fascia board cover portion. In some embodiments, the fascia board cover portion includes a cap portion extending outwardly from the fascia board cover portion, and a face portion extending downwardly from the cap portion. In some embodiments, bridge gap fascia covers according to the present invention are a one-piece construction.

Figure 5:
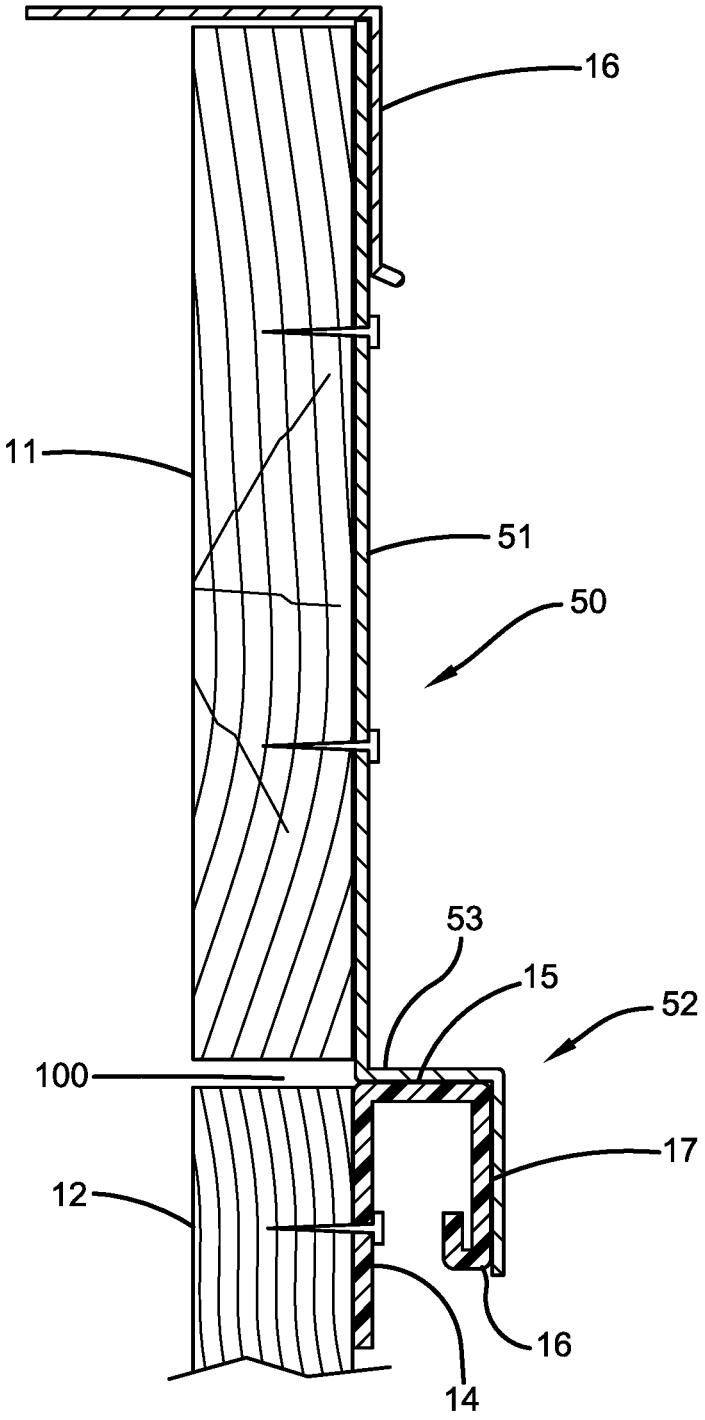
FIG. 5 is a cross-sectional view of an embodiment of a weatherproof fascia system with a cover according to the present invention.
Figure 6:
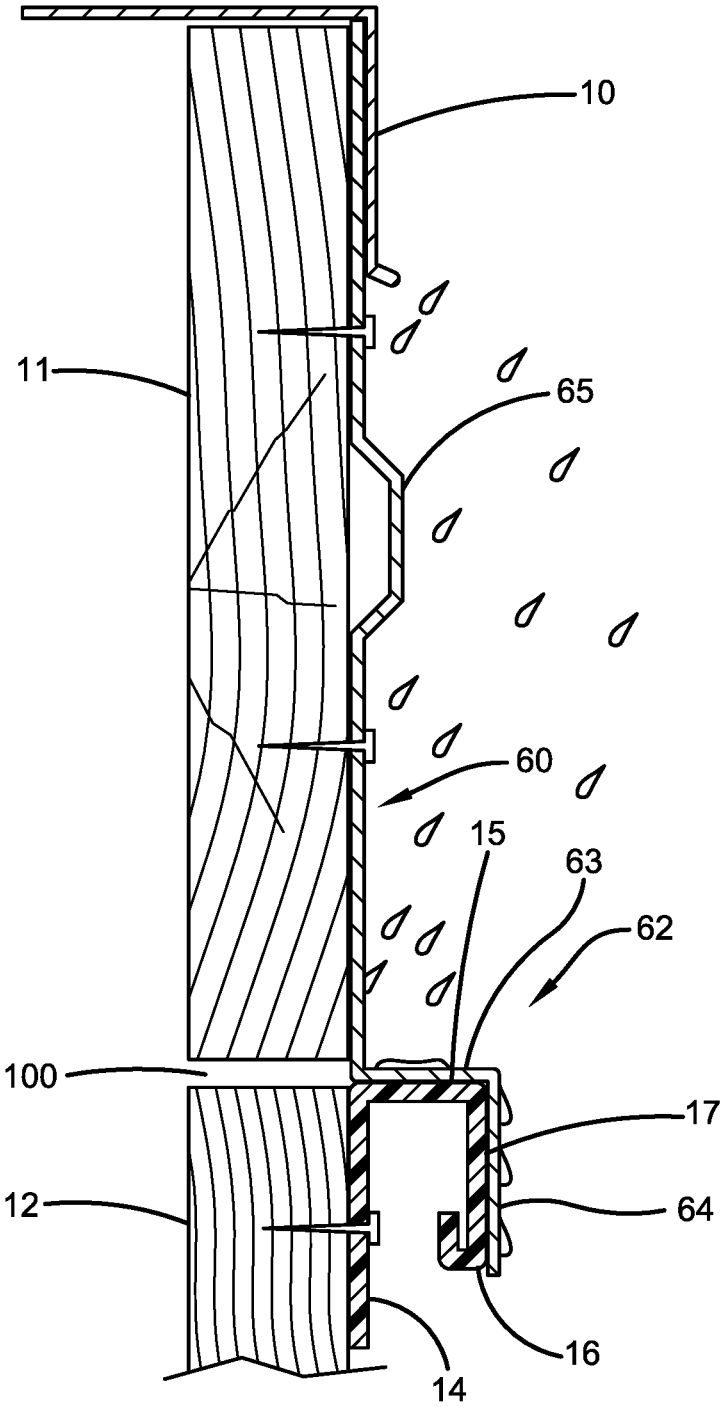
FIG. 6 is a cross-sectional view of an embodiment of a weatherproof fascia system with a cover according to the present invention.
Figure 7:
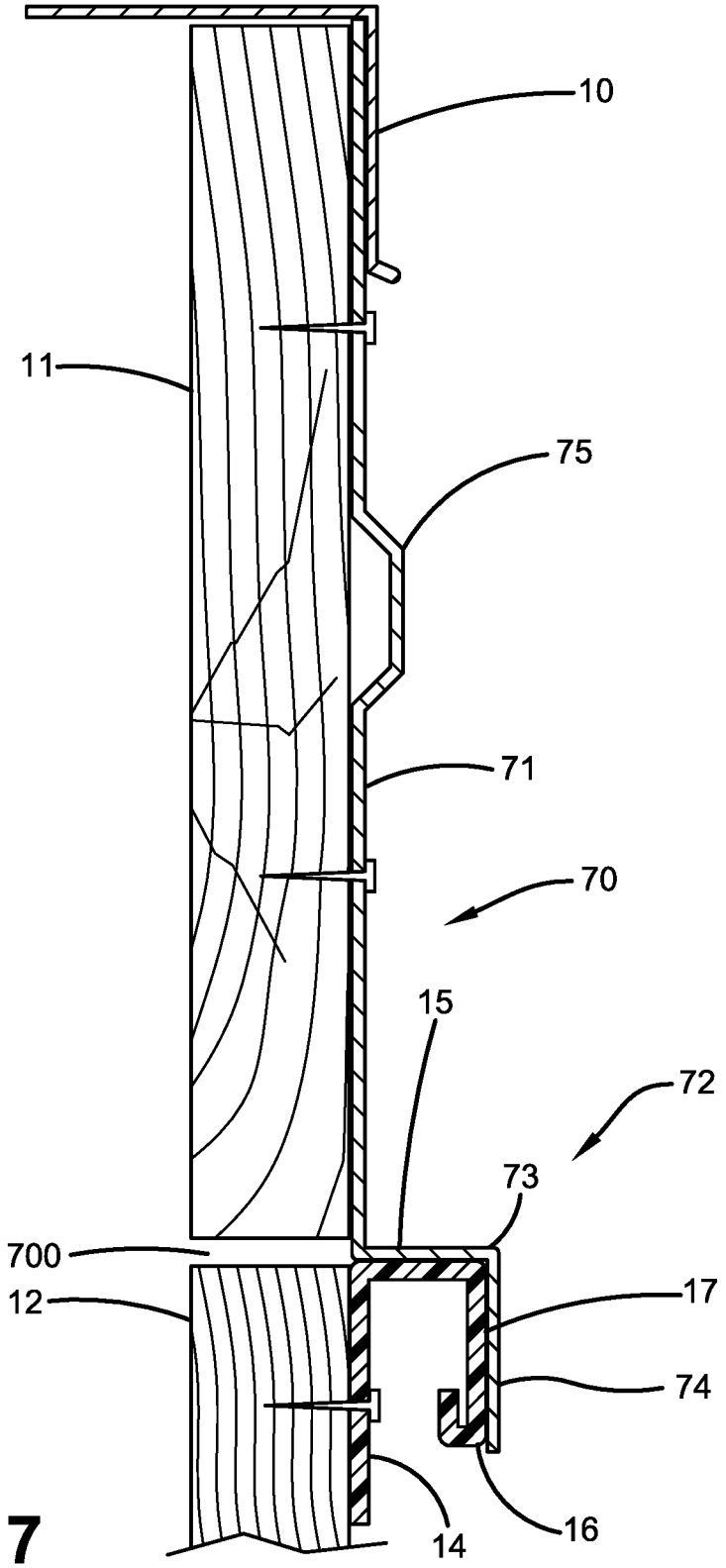
FIG. 7 is a cross-sectional view of an embodiment of a weatherproof fascia system with a cover according to the present invention.

As illustrated in FIGS. 5-7, embodiments of weatherproof bridge gap fascia covers according to the present invention are provided as installed at a roof and sidewall interface. Weatherproof bridge gap fascia covers 50, 60, 70 include fascia board cover portions 51, 61, 71, respectively, and bridge gap interface portions 52, 62, 72, respectively. Bridge gap interface portions 52, 62, 72, include cap portions 53, 63, 73, respectively, and face portions 54, 64, 74, respectively. Cap portions 52, 62, 72 extend outwardly from fascia board cover portions 51, 61, 71. Face portions 54, 64, 74 extend downwardly from cap portions 52, 62, 72. As installed, bridge gap interface portions 52, 62, 72 advantageously form a weatherproof seal at interface 100, 600, 700 of fascia board 11, 21, 31 and sidewall 12 including cladding 13 by totally blocking the path by which moisture, water, precipitation, and other debris can enter interface 100, 600, 700.

In some embodiments, bridge gap fascia covers according to the present invention are described according to the relationship between planes formed by the fascia board cover portion, cap portion, and face portion. In some embodiments, the fascia board cover portion forms a first plane. In some embodiments, the cap portion forms a second plane. In some embodiments, the face portion forms a third plane. In some embodiments, the first plane is substantially vertical, the third plane is parallel to the first plane, and the second plane intersects the first plane and the third plane such that water that contacts the bridge gap fascia cover flows away from the structure.

In some embodiments, one or more of the fascia board cover portion, cap portion, and face portion incorporate a bend or curve to accommodate a bend or curve of the structure that the weatherproof bridge gap fascia cover is being installed to.

In some embodiments, the dimensions of the weatherproof bridge gap fascia cover are selected according to the dimensions and geometries of the fascia board, sidewall, and cladding that the weatherproof bridge gap fascia cover is being installed to. As shown in FIGS. 5-7, fascia board 11, 21, 31 and sidewall 12 including cladding 13 include different heights, and widths. For example, fascia board 11 may be a 1 inch by 4 inch wooden board. Likewise, fascia board 21 may be a 1 inch by 6 inch wooden board. Finally, fascia board 31 may be a 1 inch by 8 inch wooden board. Cladding 13, includes siding 14, outward cladding extension 15, exterior cladding portion of J-channel 16, and bent end portion of J-channel 17. The outward cladding extension extends a certain distance from the siding. The cladding J-channel extends another distance from the outward cladding extension and includes a bent end portion of the J-channel. Accordingly, weatherproof bridge gap fascia covers have bridge gap cover portions sized according to the dimensions required by the installation conditions.

When weatherproof bridge gap fascia covers according to the present invention are installed such as in FIGS. 5-7, fascia board cover portions 51, 61, 71, cover fascia board 11, 21, 31. Bridge gap interface portions 52, 62, 72, cover interface 100, 600, 700, respectively including sidewall 12 and cladding 13. Cap portions 53, 63, 73, cover outward cladding extension 15, and face portions 54, 64, 74 cover exterior cladding portion of J-channel 16.

In some embodiments, the fascia board cover portion has a height of 4 inches or greater. In other embodiments, the fascia board cover portion has a height of 6 inches or greater. In other embodiments, the fascia board cover portion has a height of 8 inches or greater.

In some embodiments, the cap portion extends 0.50 inches or greater from the fascia board cover portion. In other embodiments, the cap portion extends 0.75 inches or greater from the fascia board cover portion. In other embodiments, the cap portion extends 1.00 inches or greater from the fascia board cover portion. In other embodiments, the cap portion extends 1.25 inches or greater from the fascia board cover portion. In other embodiments, the cap portion extends 1.50 inches or greater from the fascia board cover portion.

In some embodiments, the face portion extends 0.50 inches or greater from the cap portion. In other embodiments, the face portion extends 0.75 inches or greater from the fascia board cover portion. In other embodiments, the face portion extends 1.00 inches or greater from the cap portion. In other embodiments, the face portion extends 1.25 inches or greater from the cap portion. In other embodiments, the face portion extends 1.50 inches or greater from the cap portion. In other embodiments, the face portion extends 1.75 inches or greater from the cap portion. In other embodiments, the face portion extends 2.00 inches or greater from the cap portion. In other embodiments, the face portion extends 2.25 inches or greater from the cap portion. In other embodiments, the face portion extends 2.50 inches or greater from the cap portion.

In some embodiments, weatherproof bridge gap fascia covers according to the present invention comprise coated aluminum coil. In these and other embodiments, the coating of the coated aluminum coil is a polyvinyl chloride (PVC) coating. In other embodiments, weatherproof bridge gap fascia covers comprise aluminum extrusion. In other embodiments, weatherproof bridge gap fascia covers comprise vinyl extrusion.

In embodiments of weatherproof bridge gap fascia covers require added rigidity, a rigidity brake may be included. As shown in FIGS. 6 and 7, rigidity brake 65, 75 is formed in fascia board cover portion 61, 71 and provides increased strength and rigidity across the length of weatherproof bridge gap fascia cover 60, 70.

Embodiments of weatherproof bridge gap fascia covers according to the present invention may be secured to fascia board and siding according to a variety of conventional fastening means. In some embodiments, fasteners suitable for installing weatherproof bridge gap fascia covers include siding trim nails. Siding trim nails are small painted aluminum nails that are less obstructive than standard nail head size and do not rust. Other suitable fastening means include screws, bolts, clips, rivets, nails, set-screws, tape, glue, adhesive, and the like.

Methods of Producing Weatherproof Bridge Gap Fascia Covers

Embodiments of weatherproof bridge gap fascia covers according to the present invention may be readily made using bending brakes. Bending brakes are well known within the construction and building products industry. Materials suitable for forming weatherproof bridge gap fascia covers may be supplied in rolled forms and cut to smaller lengths according to the needs of an installation. Traditional bending brake methods utilize 10-foot lengths which are advantageously easier to ship, handle, and install without too much bending or distortion occurring during installation of the weatherproof bridge gap fascia covers. The bridge gap fascia product can be easily cut to length on site by the installation crews using snips and other cutting means. The material is supplied to the bending brake, which is then used to create weatherproof bridge gap fascia covers as described above.

Weatherproof bridge gap fascia covers according to the present invention may be provided in a variety of colors. The color may be custom selected according to installation need.

Weatherproof bridge gap fascia covers according to the present invention may be sized to include portions to allow for size revision allowances that are utilized during installation to create an ideal fit.

Methods of Forming Weatherproof Bridge Gap Fascia Cover Systems

Embodiments of weatherproof bridge gap fascia covers according to the present invention are suitable for a forming a weatherproof seal across a variety of installation conditions. In some embodiments, a method for forming a weatherproof bridge gap fascia cover system includes providing a fascia and cladding interface, wherein the fascia and cladding interface comprises a roofing system including a drip edge, a fascia board adjacent to the edge, and a cladding attached to a sidewall, providing a weatherproof bridge gap fascia cover, aligning the weatherproof bridge gap fascia cover with the drip edge and the cladding, and fastening the weatherproof bridge gap fascia cover to the fascia board to thereby form the weatherproof seal covering the fascia and cladding interface.

In some embodiments according to the present invention, providing a fascia and cladding interface, wherein the fascia and cladding interface comprises a roofing system including a drip edge, a fascia board adjacent to the edge, and a cladding attached to a sidewall includes identifying the dimensions of one or more of the drip edge, fascia board, and cladding attached to the side wall. Identifying the dimensions of one or more of the drip edge, fascia board, and cladding attached to the sidewall is necessary to select the appropriate weatherproof bridge gap fascia cover.

In some embodiments according to the present invention, providing a weatherproof bridge gap fascia cover includes forming a weatherproof bridge gap fascia cover. In these and other embodiments, providing a weatherproof bridge gap fascia cover includes modifying the dimensions of the weatherproof bridge gap fascia cover according to the dimensions of one or more of the drip edge, fascia board, and cladding attached to the sidewall. This is to ensure that a uniform seal and cosmetically pleasing finish are formed during the installation of the weatherproof bridge gap fascia cover.

In some embodiments according to the present invention, aligning the weatherproof bridge gap fascia cover with the drip edge and the cladding includes positioning the weatherproof bridge gap fascia cover between the fascia board and the drip edge and in alignment with the cladding attached to the sidewall. This is to ensure that a uniform seal and cosmetically pleasing finish are formed during the installation of the weatherproof bridge gap fascia cover.

In some embodiments according to the present invention, fastening the weatherproof bridge gap fascia cover to the fascia board to thereby form the weatherproof seal covering the fascia and cladding interface includes using a fastening means such as siding trim nails to secure the weatherproof bridge gap fascia cover to the fascia board.

In some embodiments according to the present invention, the fascia board includes a preexisting fascia cover. In these and other embodiments, the step of fastening the weatherproof bridge gap fascia cover to the fascia board further includes fastening the weatherproof bridge gap fascia cover to the preexisting fascia cover. Such installations may be referred to as a retrofit installation.

In light of the foregoing, it should be appreciated that the present invention significantly advances the art by providing weatherproof bridge gap fascia covers that are structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A weatherproof bridge gap fascia cover comprising:

a fascia board cover portion having a height of about 4 inches or greater and forming a substantially vertical first plane, wherein a top portion of the fascia board cover portion is configured to be received and pinned between a fascia board and a face of a drip edge of a roof; and a bridge gap interface portion, wherein the bridge gap interface portion includes a cap portion extending outwardly from the fascia board cover portion by 0.5 inches or greater, forming a second plane, and a face portion extending downwardly from the cap portion forming a substantially vertical third plane, wherein the face portion is dimensioned to extend over and cover a J-channel portion of a cladding attached to a sidewall.

2. The weatherproof bridge gap fascia cover of claim 1, wherein the fascia board cover portion and bridge gap interface portion is a one-piece construction.

3. The weatherproof bridge gap fascia cover of claim 1, wherein the fascia board cover portion includes a rigidity bend.

4. The weatherproof bridge gap fascia cover of claim 1, wherein the weatherproof bridge gap fascia cover is 10 feet long.

5. The weatherproof bridge gap fascia cover of claim 1, comprising a material selected from the group consisting of coated aluminum coil, aluminum extrusion, and vinyl extrusion.

6. The weatherproof bridge gap fascia cover of claim 1, wherein the substantially vertical first plane is parallel to the substantially vertical third plane.

7. The weatherproof bridge gap fascia cover of claim 1, wherein the second plane is perpendicular to the substantially vertical first plane.

8. The weatherproof bridge gap fascia cover of claim 1, wherein the substantially vertical first plane is parallel to the substantially vertical third plane, and wherein the second plane is perpendicular to the substantially vertical first plane.

* * * * *